US005882261A

United States Patent [19]

Adams

[11] Patent Number: 5,882,261

[45] Date of Patent: Mar. 16, 1999

[54] METHOD OF PLAYING GAME AND GAMING DEVICE WITH AT LEAST ONE ADDITIONAL PAYOUT INDICATOR

[75] Inventor: William R. Adams, Las Vegas, Nev.

[73] Assignee: Anchor Gaming, Las Vegas, Nev.

[21] Appl. No.: 722,379

[22] Filed: Sep. 30, 1996

[51] Int. Cl.[6] ..... G07F 17/34; A63F 7/02

[52] U.S. Cl. ..... 463/20; 273/143 R; 273/121 B

[58] Field of Search ..... 273/143 R, 138 A, 273/138 R, 121 R, 121 A, 121 B, 121 D, 121 E, 120 A, 120 R; 463/20

[56] References Cited

U.S. PATENT DOCUMENTS

| | | | |
|---|---|---|---|
| 4,871,171 | 10/1989 | Rivero | 273/144 R |
| 5,205,555 | 4/1993 | Hamano | 273/143 R |
| 5,342,049 | 8/1994 | Wichinsky | 273/143 A |
| 5,344,145 | 9/1994 | Chadwick et al. | 273/145 R |

FOREIGN PATENT DOCUMENTS

| | | | |
|---|---|---|---|
| 0333338 | 9/1989 | European Pat. Off. . | |
| 1474617 | 3/1967 | France . | |
| 2938307 | 4/1981 | Germany | 273/143 R |
| 3700861 | 7/1988 | Germany . | |
| 4014477 | 7/1991 | Germany . | |
| 1242298 | 8/1971 | United Kingdom | 273/143 R |
| 2066991 | 7/1981 | United Kingdom | 273/143 R |
| 2072395 | 9/1981 | United Kingdom | 273/143 R |
| 2084371 | 4/1982 | United Kingdom . | |
| 2201821 | 9/1988 | United Kingdom . | |
| 2202884 | 10/1988 | United Kingdom . | |

OTHER PUBLICATIONS

Cover and pp. 91 and 101 of *Intergame* Magazine Published in England in Jun., 1995.

Advertisement, Bally Distributing Company Double or Nothing, Model 1083, Chapter 11–1974–1984, p. 267.

*An Illustrated Price Guide to the 100 Most Collectable Trade Stimulators* by: Richard M. Bueschel; pp. 21, 29, 83; Published in U.S., 1978.

*Slots 1*; by: Richard M. Bueschel; pp. 136, 142; Published in U.S. in 1978, Revised in 1981 and 1988.

Ad and Cover of *Intergaming* Magazine, Published in England in Jun., 1995.

*Slot Machines on Parade,* by: Robert N. Geddes; p. 128; Published in U.S. Oct. 1980.

*Slot Machines;* by Marshall Fey; pp. 126 and 150; Published in Reno, Nevada in 1983, 2nd 1989, 3rd 1991.

*Primary Examiner*—Benjamin H. Layno

*Attorney, Agent, or Firm*—Galgano & Burke

[57] ABSTRACT

Methods of playing games and gaming devices useful with playing games comprise a standard gaming unit, e.g., three reels, and a discernible additional payout indicator. The additional payout indicator comprises a value selector and a multiplier, wherein the multiplier comprises a pinball-type game. According to a preferred embodiment the multiplier also comprises a rotatable reel into which the pinball drops in order to determine one of a plurality of values. The points attained during the pinball-type game play are utilized in the calculation of the multiplier value.

31 Claims, 5 Drawing Sheets

METHOD OF PLAYING GAME AND GAMING DEVICE WITH AT LEAST ONE ADDITIONAL PAYOUT INDICATOR

The present invention is directed to methods of playing wagering games and gaming devices comprising at least one additional payout indicator capable of indicating at least one of a plurality of additional payouts. The bonus indicators of the present invention preferably comprise at least one additional payout multiplier comprising a pinball-type game.

BACKGROUND OF THE INVENTION

Games of chance have been enjoyed by people for thousands of years and have enjoyed widespread popularity in recent times. Many people enjoy playing a wide variety of games that they have not previously been played. Playing new games adds to the excitement of this recreational activity particularly when some form of "gaming" is involved. As used herein, the term "gaming" and "gaming devices" are used to indicate that some form of wagering is involved, and that players must make wagers of value, whether actual currency or some equivalent of value, e.g., token or credit.

One popular game of chance that has long been enjoyed by many players is the slot machine. Conventionally, a slot machine is configured for a player to input something of value, e.g., a standard denomination of currency or house token or other representation of currency or credit, and then to permit the player to activate the device which causes a plurality of reels to spin and ultimately stop to display a random combination of some form of indicia, for example, numbers or symbols. If this display contains one of a preselected plurality of winning combinations, the machine releases money into a payout chute or onto a credit meter for the player. For example, if a player initially wagered two coins of a national currency and that player won a high payout, that player may receive fifty coins of the same denomination in return.

Since it is desirable to offer players games which they have not played before, it would be desirable to provide a player with new games and additional opportunities to receive winning payouts. It would be particularly desirable to provide new methods of determining the amounts of such winning payouts.

It would therefore also be desirable to provide novel additional payout indicators which are discernible by a player and/or other observers.

SUMMARY OF THE INVENTION

Various embodiments of the present invention comprise gaming devices having a first gaming unit and at least one discernible indicia of an additional payout indicator. Preferred embodiments of the present invention comprise an additional payout indicator comprising a multiplier and a value indicator wherein an additional payout is indicated to a player as the product of the value shown by the value indicator and the multiplier. According to the most preferred embodiments, the additional payout indicator is clearly visible to a player and is operable when primary reels of a slot machine stop on certain predetermined indicia. The disclosed multiplier comprises a pinball-type game.

According to one preferred embodiment of the present invention, a base unit comprises a three-reel slot machine and a bonus indicator comprising a multiplier component and an additional payout indicator. The total additional payout to a player is determined by multiplying the multiplier with the additional payout indicator amount. According to one preferred embodiment of the present invention, the value of the multiplier is determined before the base additional payout amount through the operation of a pinball-type game and a rotating wheel. The pinball-type game is preferably operated by the player but can also be determined through the automatic operation of the gaming device. The second component of the additional payout indicator comprises a fourth reel.

The rotatable bonus wheel can be caused to spin automatically or in response to some action by a player, e.g., the player pushing a button, when the primary reels indicate one of a predetermined plurality of indicia.

As described in more detail below, it is within the scope of the present invention to provide a payout from the primary gaming unit, a payout indicated by the additional payout indicator only, a payout from the primary gaming unit or the additional payout indicator as changed by the multiplier, or a separate, plurality of payouts from the primary gaming unit and the additional payout indicator either with or without modification by a multiplier.

According to one preferred embodiment of the present invention, the mechanical bonus payout indicator is electromechanically operated and is linked to a random number generator which determines where the bonus indicator actually stops.

According to another preferred embodiment of the present invention, when the primary reels stop on one of a predetermined plurality of winning indicia sets, a bonus actuator is placed in an active state. According to this embodiment, a person, such as the player, must actuate a pinball plunger in order to operate the additional payout indicator.

According to another embodiment of the present invention, the additional payout actuator requires operator intervention so that a player must involve a casino attendant who can activate the additional payout indicator.

Still other embodiments of the present invention comprise gaming devices having electronic means for displaying indicia of rotatable reels such as a video screen and/or means for displaying indicia of a bonus payout indicator, such as a video screen.

The present invention also comprises methods for playing a game of chance. One preferred method comprises the steps of a first displaying a randomly selected combination of indicia, said displayed indicia selected from the group consisting of slot reels, indicia of reels, indicia of playing cards, and combinations thereof; said first, standard gaming unit comprising means for generating at least one signal corresponding to at least one select display of indicia; and providing at least one discernible indicia of an additional payout indicator comprising a pinball-type game.

DETAILED DESCRIPTION

Figure 1:
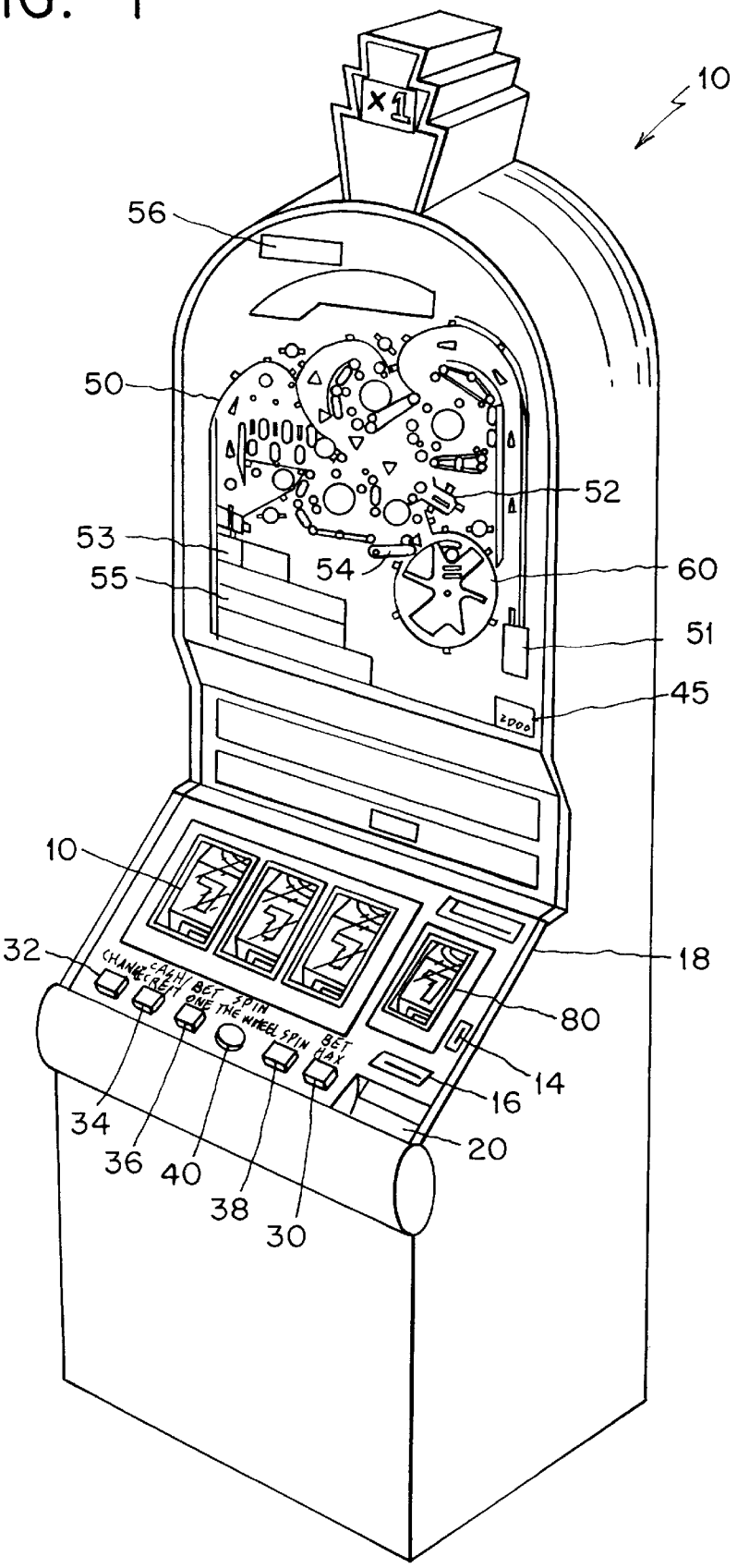
FIG. 1 is a perspective view of a gaming device of one embodiment of the present invention.
Figure 2:
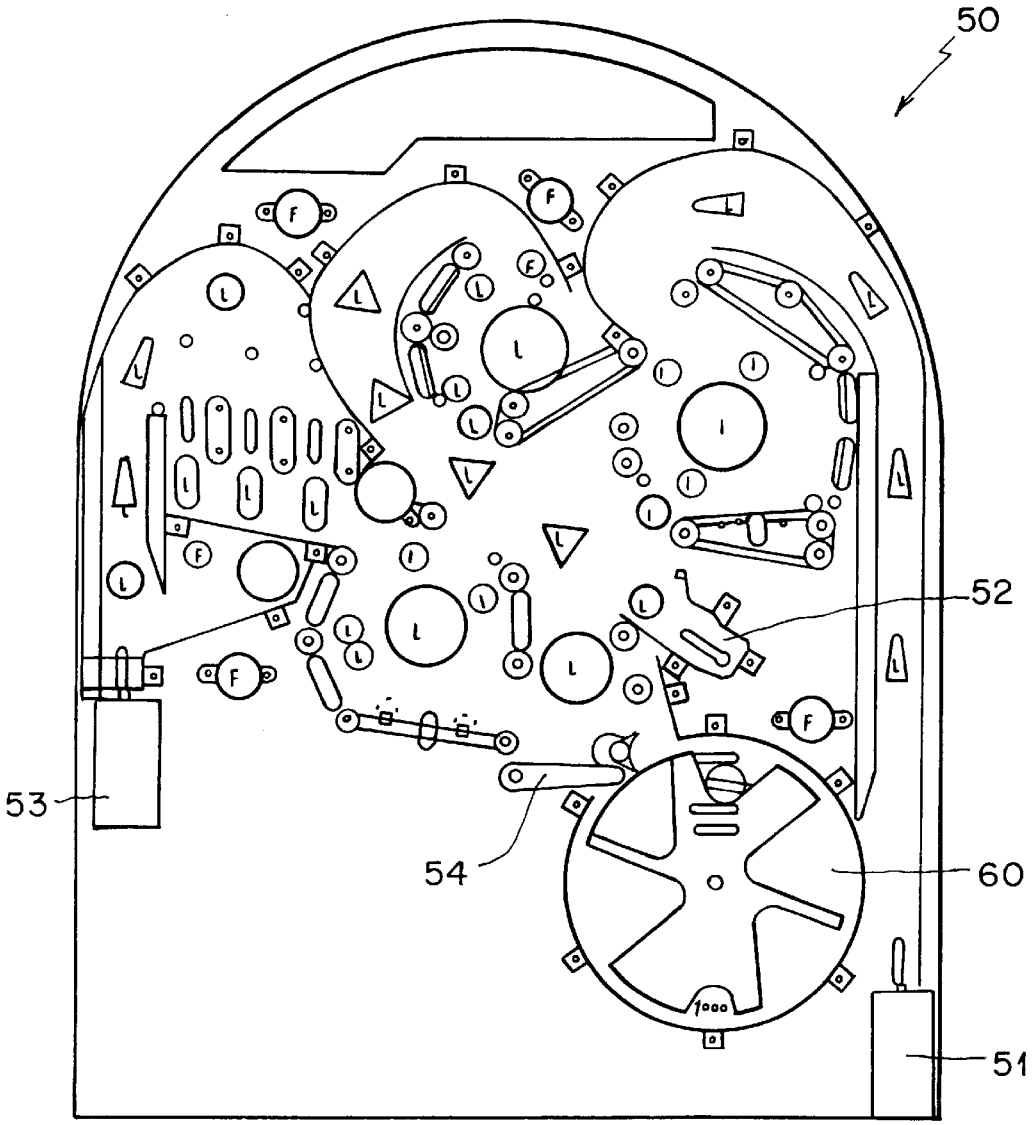
FIG. 2 is a plan view of the pinball-type component of the embodiment of the present invention shown in FIG. 1.
Figure 3:
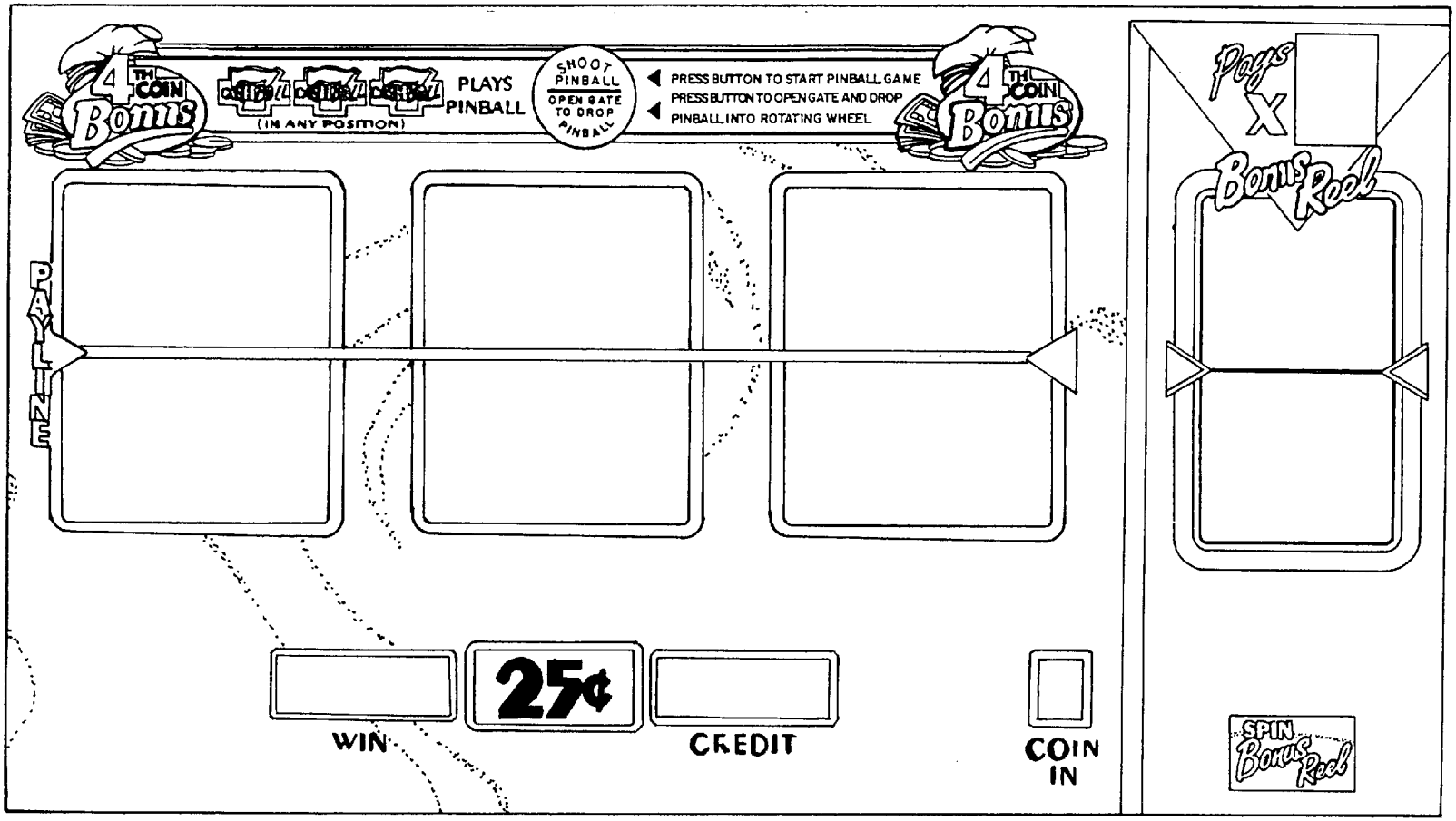
FIG. 3 is a view of the reel area of one embodiment of the present invention.
Figure 4:
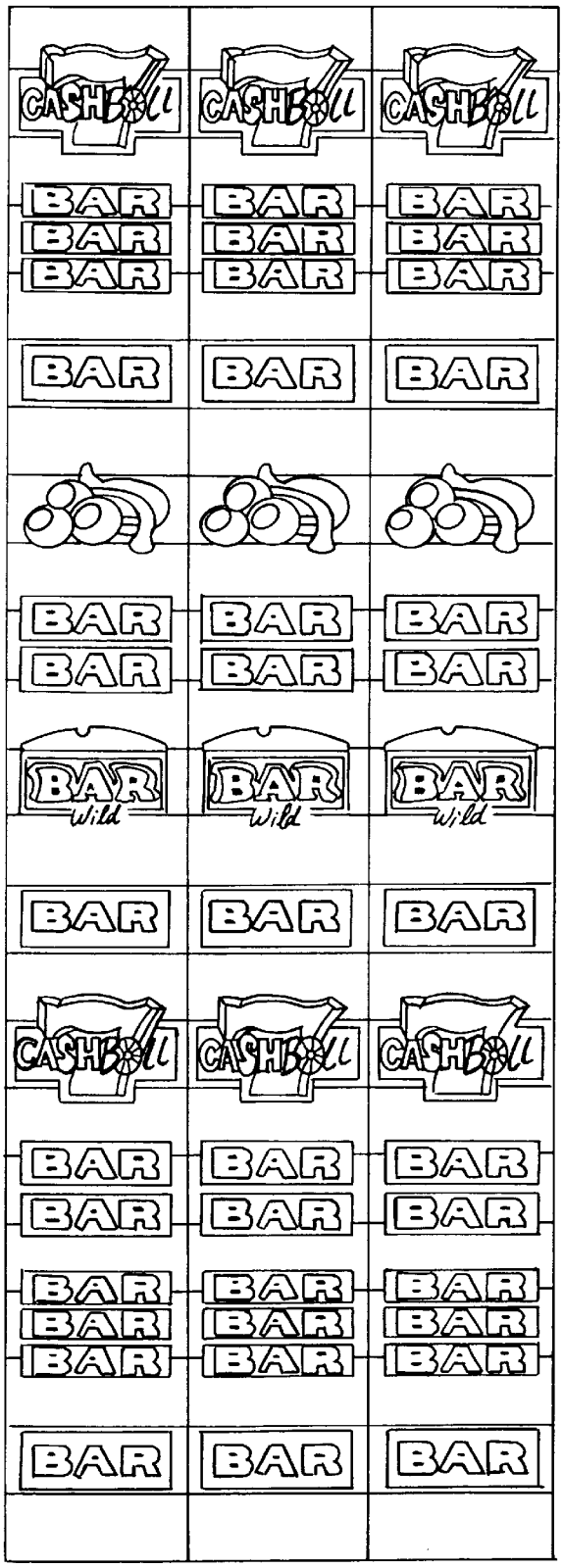
FIG. 4 illustrates the indicia utilized with the main reels of one embodiment of the present invention.
Figure 5:
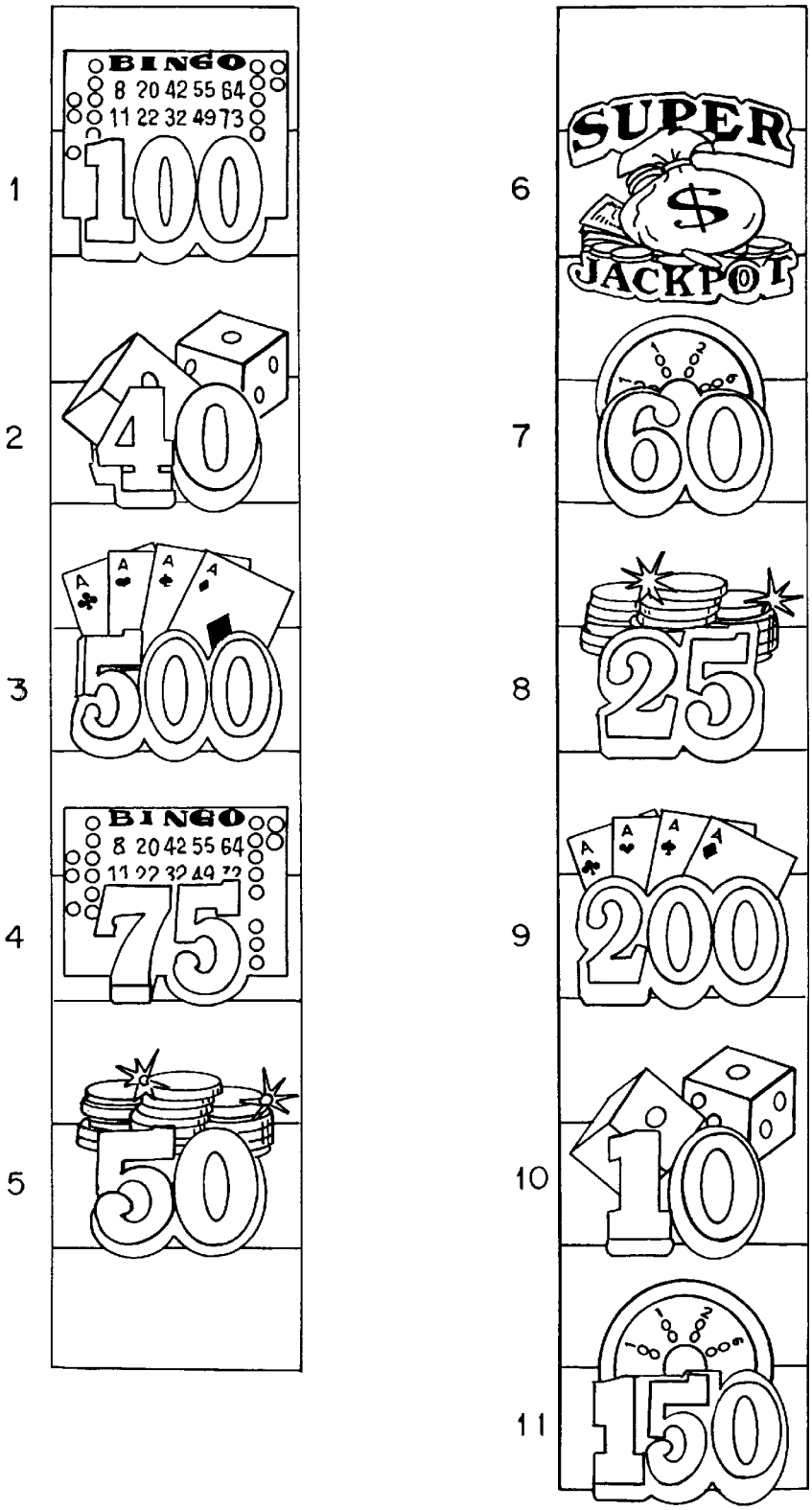
FIG. 5 illustrates the indicia of the fourth reel of one embodiment of the present invention.

The various embodiments of the present invention are designed to provide added excitement to a gaming device in order to increase the enjoyment to players and to serve as an added attraction to potential players. One preferred embodiment of the present invention, illustrated in FIG. 1, comprises a primary gaming unit which comprises three rotatable reels 10, each of which comprise a plurality of indicia on the periphery thereof, and an additional payout indicator comprising two components. The first component is a pinball-type game 50 and the second component comprises a fourth reel 80. The illustrated gaming device comprises a coin slot 14, currency validator 16 and a credit card validator 18. In a manner which will be recognized by those skilled in the art, each reel 10 is designed to rotate and then stop in order to visually display at least one, and preferably a number of indicia. If the collection of indicia displayed by the three reels is one of a predetermined plurality of winning indicia sets, then the player can typically be provided with a winning payout either through coin chute 20 which deposits winnings into a coin trough or by increasing the player's credits in a credit window 45.

According to one aspect of the present invention, when the reels 10 display a particular indicia set then the player is provided with an opportunity for an additional payout. According to this illustrated embodiment of the present invention, the additional payout is indicated as the product of two components. One component is a multiplier which can increase the value indicated on the fourth reel by any desired amount, e.g., 1×, 2×, and 3×. The other component is an amount which is indicated by a fourth reel 80. In this illustrated embodiment, the multiplier is determined prior to the spinning of the fourth reel.

In this illustrated embodiment, the value of the multiplier is determined by the outcome of a pinball-type game 50. The possible scores that can be achieved from the pinball game are preferably listed on a payout schedule 55 in ranges with each attained range corresponding with a multiplier value, e.g., 1×, 2×, 3×, etc. For example, scores between zero and 9,999 are assigned a multiplier value of one (1×), scores from 10,000 to 19,999 are assigned a multiplier value of two (2×) and scores from 20,000 and up get a multiplier of three times (3×).

The pinball-type game is activated when a player gets one of a predetermined indicia or set of indicia on the primary game, i.e., the three-reel slot machine. A pinball is placed onto a launcher 51 and the player is given a set amount of time to activate the launcher, e.g., five seconds, or the launcher is activated automatically. The launcher sends the ball into a pinball-style field of bumpers and targets. The pinball bounces around and accumulates points which are indicated in point window 56. In the illustrated embodiment, after the ball traverses a first portion of the pinball board, the ball is ejected from a second plunger 52 and then subsequently from a third plunger 53. The illustrated embodiment also comprises a player actuatable flipper 54 which provides the player with input to the number of points attained. The player may be provided with one or more turns with a ball passing through the pinball-style field. On the player's last ball, the ball is positioned above a spinning wheel. The rotating wheel 60 comprises a plurality of segments which bear designated different values. Suitable player controls including CHANGE button 32, CASH/CREDIT button 34, BET ONE button 36, plunger actuate button 38 and BET MAX button 30 are also provided.

That value is then added to the points already accumulated in window 56 during the pinball-type game. The total number of points from the pinball game is then converted to a multiplier as indicated above.

After the multiplier value, e.g., 1×, 2× or 3×, has been determined, that value is preferably displayed above the fourth reel. The fourth reel is then rotated and, upon stopping, indicates a base additional payout which is then multiplied by the multiplier and the resulting product value is awarded to the player. The player's additional payout can be credited to a credit meter or can be actually provided through a coin trough.

From the present description, it will be appreciated that a gaming device is provided with a base game and an opportunity for an additional payout wherein the value of the final additional payout is determined in part upon the value of a multiplier. According to the preferred illustrated embodiment of the present invention described above, the multiplier is determined, at least in part, utilizing a pinball-type game.

According to another embodiment of the present invention, when reels 10 display an indicia set which will provide a bonus, the additional payout indicator becomes activatable but requires intervention by a house attendant, such as a casino attendant, in order to actuate the additional payout indicator. According to this embodiment of the present invention, the casino is provided with greater control over the actuation of the additional payout indicator and, if desired, can accompany the actuation of the bonus indicator with great fanfare. It will be appreciated that the amounts of the additional payout indicated in the figures are merely for purposes of illustration and, if desired, the amounts on the additional payout indicator can have a significantly greater value. For example, one of the areas on the bonus indicator may correspond to a new automobile, a luxury vacation or a very large sum of money.

While the first component in the illustrated multiplier of the present invention in FIG. 1 is generally in the form of a pinball-type game, other visible, mechanical indicia can be provided, whether controlled totally mechanically, electromechanically, or electronically without departing from the scope of the present invention.

It is also within the scope of the present invention to provide non-monetary prizes or losing spaces wherein no additional prize is provided and/or wherein the prize normally associated with the indicia shown on the primary gaming unit reels 110 is reduced.

When the game is not in use, the pinball component, the rotatable wheel, and/or the fourth reel can be set to an attract mode wherein a message is displayed to potential players or play is simulated.

A less preferred embodiment of the present invention comprises a bonus indicator is in the form of an electronically generated image, such as a video screen or an LED display and provides discernible indicia, e.g., a visual video display, of a pinball-type game and a video display of three reels with a fourth bonus reel. While separate screens are preferred, both the reels and the pinball game indicator could be displayed on the same video screen.

The illustrated embodiment of the present invention is considered most preferable since it is believed that players prefer to see actual slot reels and an actual pinball game in a gaming device. Other, less preferred embodiments are also possible while providing some of the advantages of the present invention. Specifically, it is feasible to replace the spinning reels with other forms of standard gaming units, for example, a visible indicia of reels or indicia of playing cards, shown for example on a video screen. It is also possible to replace the rotatable wheel with some other discernible indicia of a mechanical bonus indicator.

As stated above, the present invention also includes methods of conducting a wagering game of chance comprising the steps of providing a player with an opportunity to place a wager, displaying a randomly selected combination of indicia, said displayed indicia selected from the group consisting of reels, indicia of reels, indicia of playing cards, and combination thereof, generating at least one signal corresponding to at least one select display of said indicia, providing at least one discernible indicia of an additional payout indicator, said additional payout indicator comprising a multiplier in the form of a pinball-type game.

What is claimed is:

1. A gaming device comprising:

a first gaming unit for displaying a randomly selected combination of indicia, said displayed indicia selected from the group consisting of reels, indicia of reels, indicia of playing cards, and combinations thereof;

means for generating at least one signal corresponding to at least one predetermined display of indicia by said first gaming unit;

a payout indicator responsive to said signal and comprising at least one value indicator and a multiplier, and further comprising indicia of a pinball-type game, wherein said payout indicator means is operatively connected to said first gaming unit.

2. A gaming device according to claim 1 wherein said value indicator comprises a wheel.

3. A gaming device according to claim 2 wherein said wheel is rotatable.

4. A gaming device according to claim 1 wherein said first gaming unit comprises indicia of reels.

5. A gaming device according to claim 1 wherein said first gaming unit comprises three reels.

6. A gaming device according to claim 5 wherein said payout indicator comprises at least one reel.

7. A gaming device according to claim 1 wherein said first gaming unit comprises indicia of playing cards.

8. A gaming device according to claim 1 wherein said multiplier is utilized to determine one of a plurality of values by which a payout may be multiplied.

9. A gaming device according to claim 8 wherein said multiplier broadcasts at least one message other than a multiplier by which a payout may be multiplied.

10. A gaming device according to claim 8 wherein said multiplier is randomly controlled.

11. A gaming device according to claim 10 wherein said pinball is randomly controlled.

12. A gaming device according to claim 11 wherein said payout indicator comprises an audio speaker.

13. A gaming device according to claim 1 wherein said multiplier further comprising a plurality of slots into which said pinball may drop.

14. A gaming device according to claim 13 wherein a player controls the drop of said pinball.

15. A gaming device according to claim 1 wherein said payout indicator comprises a video screen.

16. A gaming device according to claim 1 wherein said payout indicator comprises an audio speaker.

17. A gaming device according to claim 1 wherein said first gaming unit comprises a plurality of reels.

18. A gaming device according to claim 17 wherein said payout indicia comprises a reel.

19. A gaming device according to claim 17 wherein said payout multiplier comprises a wheel comprising segments with different values.

20. A gaming device comprising:

a first gaming unit for displaying a randomly selected combination of indicia, said displayed indicia selected from the group consisting of reels, indicia of reels, indicia of playing cards, and combinations thereof;

means for generating at least one signal corresponding to at least one select display of indicia;

means for providing at least one discernible indicia of a mechanical payout indicator, said providing means indicating at least one of a plurality of possible payouts, wherein said providing means is operatively connected to said first gaming unit and actuatable in response to said signal; and means for generating at least one discernible indicia of an additional payout comprising a payout multiplier in the form of a pinball-type game.

21. A gaming device according to claim 20 wherein said payout indicia comprises indicia of a reel.

22. A method of conducting a wagering game of chance comprising the steps of:

providing a player with an opportunity to place a wager;

displaying a randomly selected combination of indicia, said displayed indicia selected from the group consisting of reels, indicia of reels, indicia of playing cards, and combination thereof;

generating at least one signal corresponding to at least one select display of said indicia;

providing at least one discernible indicia of a payout indicator in response to said signal, said additional payout indicator comprising a multiplier in the form of a pinball-type game.

23. A method of conducting a wagering game of chance according to claim 22 wherein said step of providing indicia of a payout indicator comprises providing indicia of a rotatable wheel.

24. A method of conducting a game of chance according to claim 22 wherein said displaying step comprises displaying a plurality of reels.

25. A method of conducting a game of chance according to claim 24 wherein said providing step comprises displaying a plurality of bonus indicia on a wheel.

26. A method of conducting a game of chance according to claim 22 wherein said providing step comprises displaying a plurality of bonus indicia on a wheel.

27. A gaming device comprising:

a first gaming unit for displaying a randomly selected combination of indicia, said displayed indicia selected from the group consisting of reels, indicia of reels, indicia of playing cards, and combinations thereof;

means for generating at least one signal corresponding to at least one predetermined display of indicia by said first gaming unit;

a payout indicator responsive to said signal and comprising at least one value indicator comprising a wheel, a multiplier, and indicia of a pinball-type game, wherein said payout indicator means is operatively connected to said first gaming unit.

28. A gaming device comprising:

a first gaming unit for displaying a randomly selected combination of indicia, said displayed indicia selected from the group consisting of reels, indicia of reels, indicia of playing cards, and combinations thereof;

means for generating at least one signal corresponding to at least one select display of indicia;

means for providing at least one discernible indicia of a mechanical payout indicator, said providing means indicating at least one of a plurality of possible payouts, wherein said providing means is operatively connected to said first gaming unit and actuatable in response to said signal; and means for generating at least one discernible indicia of a payout comprising a payout multiplier, a payout indicator in the form of a wheel comprising segments with different values, and a pinball-type game.

29. A method of conducting a wagering game of chance comprising the steps of:

providing a player with an opportunity to place a wager;

displaying a randomly selected combination of indicia, said displayed indicia selected from the group consisting of reels, indicia of reels, indicia of playing cards, and combination thereof;

generating at least one signal corresponding to at least one select display of said indicia;

providing at least one discernible indicia of a payout indicator in response to said signal, said payout indicator comprising a multiplier, a pinball-type game and indicia of a rotatable wheel.

30. A method of conducting a game of chance according to claim 29 wherein said providing step comprises displaying a plurality of payout indicia on a wheel.

31. A gaming device comprising:

a first gaming unit for displaying a randomly selected combination of indicia, said displayed indicia selected from the group consisting of reels, indicia of reels, indicia of playing cards, and combinations thereof;

means for generating at least one signal corresponding to at least one predetermined display of indicia by said first, standard gaming unit;

a payout indicator responsive to said signal and comprising a multiplier operatively linked and responsive to a pinball-type game comprising a substantially vertical play field.

* * * * *